US005233771A

United States Patent [19]

Simson et al.

[11] Patent Number: 5,233,771

[45] Date of Patent: Aug. 10, 1993

[54] SELECTIVE BANNER-DISPLAY DEVICE

[75] Inventors: Anton K. Simson, Poway; Peter C. Brusso, Escondido, both of Calif.

[73] Assignee: Eesti Engineering, LLC, Poway, Calif.

[21] Appl. No.: 883,665

[22] Filed: May 15, 1992

[51] Int. Cl.[5] ..... G09F 11/02

[52] U.S. Cl. ..... 40/499; 40/497

[58] Field of Search ..... 40/378, 475, 493, 497, 40/499, 532

[56] References Cited

U.S. PATENT DOCUMENTS

| | | | |
|---|---|---|---|
| 2,116,287 | 5/1938 | Schewelov | 40/475 X |
| 2,552,448 | 5/1951 | Ortendahl . | |
| 3,352,042 | 11/1967 | Nerwin . | |
| 3,726,031 | 4/1973 | Singer . | |
| 4,257,179 | 3/1981 | Oka | 40/378 |
| 4,498,256 | 2/1985 | Tanaka et al. . | |
| 4,520,583 | 6/1985 | Oka | 40/378 |
| 4,658,524 | 4/1987 | Jackson et al. . | |

*Primary Examiner*—Kenneth J. Dorner
*Assistant Examiner*—Brian K. Green
*Attorney, Agent, or Firm*—Henri J. A. Charmasson

[57] ABSTRACT

An apparatus for randomly and successively selecting and displaying each one out of a stack of banners comprises a wind-in roller around which the entire stack of banners is wound, front face down, with the leading edges of the banners being staggered in an overlapping arrangement on the periphery of the wound stack. A knife bears against the periphery of the stack, compacts and constringes the banners as the wind-in roller is rotated in the direction opposite the winding direction of the stack. The rotation is stopped when the leading edge of the selected banner is near the edge of the knife. The rotation of the wind-in roller is reversed, causing the knife to lift the leading edge of the selected banner and to peel off that banner and all other banners located above it in the stack. A wind-out mechanism places the peeled off banners into a display frame with the inner, front face of the selected one exposed to view. A variation of this device a second knife to separate the selected banner from those located above it so that only the selected banner is displayed. This option allows for back lighting of the selected banner within the display frame.

13 Claims, 3 Drawing Sheets

FIG 3
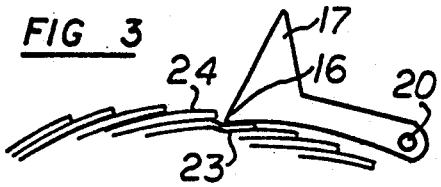
FIG 4
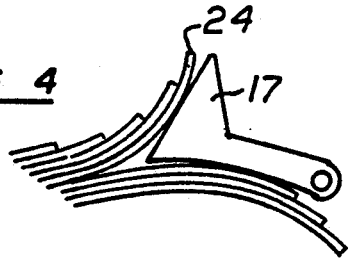
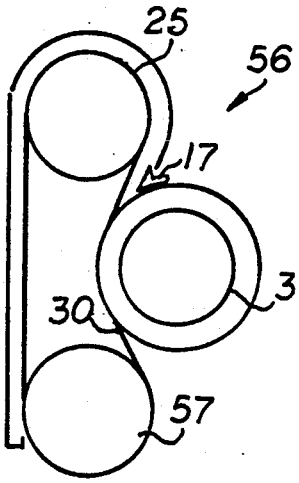
FIG 6
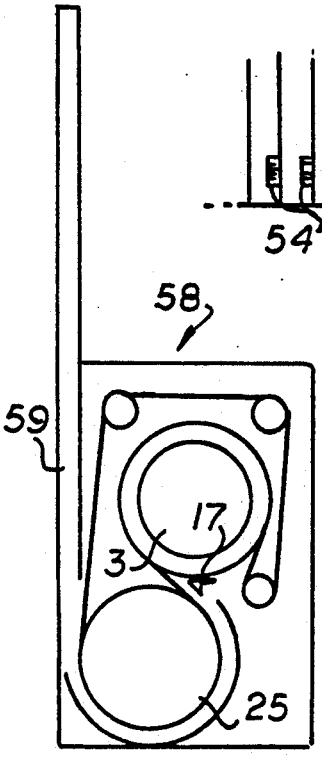
FIG 7
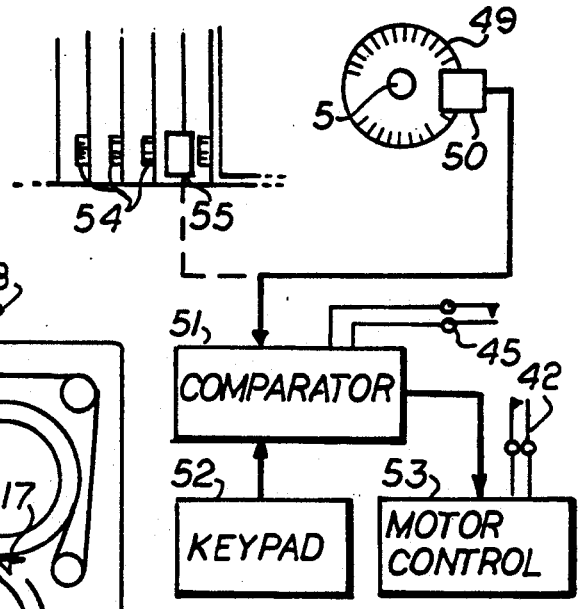
FIG 5
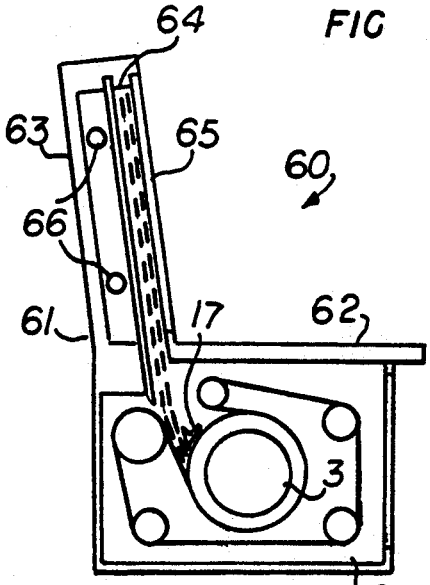
FIG 8
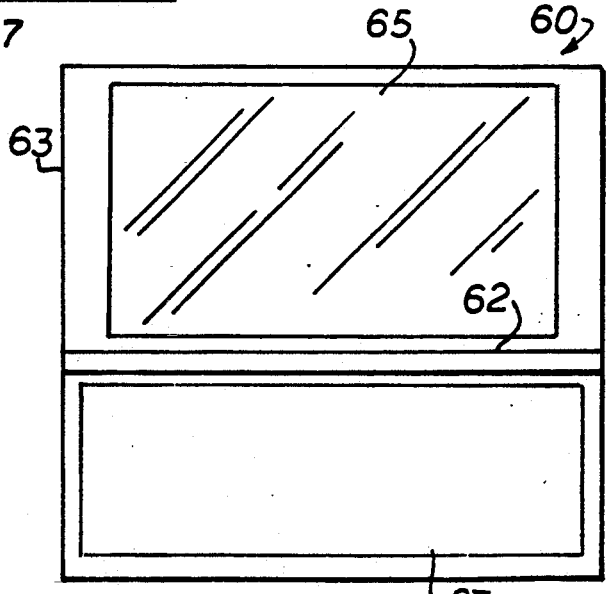
FIG 9

SELECTIVE BANNER-DISPLAY DEVICE

FIELD OF THE INVENTION

This invention relates to moving signs and updatable advertising displays, and more specifically to selective banner display devices.

BACKGROUND OF THE INVENTION

Current banner display devices as exemplified by U.S. Pat. No. 3,726,031 Singer use a string of banners taped sequentially together and wound upon a pair of rollers in opposite sides of a display frame. In order to display any banner, the entire string must be scrolled until the desired banner is properly centered within the display frame. Accordingly, any random and successive display of banners requires considerable time of unsightly back and forth scrolling of the banners. The updating of a banner requires the cumbersome cutting away of a banner and the retaping of a substitute. The prior art does not offer a practical means for randomly selecting one of a stack of display banners or other documents.

SUMMARY OF THE INVENTION

The principal and secondary objects of this invention are to provide a convenient and rapid means for randomly and sequentially picking banners out of a stack and feed them into a display frame; and to conveniently update the inventory of banners by facilitating substitution of any of them.

These and other objects are achieved by an electromechanical apparatus in which a stack of banners are wound around a wind-in roller with their leading edges staggered in an overlapping arrangement around the periphery of the wound stack. A knife bearing against the stack periphery lifts the leading edge of the selected banner and peels off that banner and all other banners located above it. The peeled off banners are guided into a display case which exposes the inward face of the selected one. In an alternate embodiment of the invention, a second knife is used to separate the selected banner from the other ones located above it, and to direct the latter toward a temporary storage station while the selected one placed into the display case. The case can be backlighted to highlight the displayed banner.

BRIEF DESCRIPTION OF THE DRAWINGS

FIG. 3 is a detail view of the position of the banner peeling knife at the start of the selecting process;

FIG. 4 is a detail view of the peeling action of the knife;

FIG. 5 is a block diagram of the banner selection system;

FIG. 6 is a diagram of a first alternate embodiment of the wind-out mechanism;

FIG. 7 is a diagram of a second alternate embodiment of the wind-out mechanism;

FIG. 8 is a side view of the banner display apparatus incorporated into a bench;

FIG. 9 is a front view thereof;

DESCRIPTION OF THE PREFERRED EMBODIMENTS OF THE INVENTION

Figure 1:
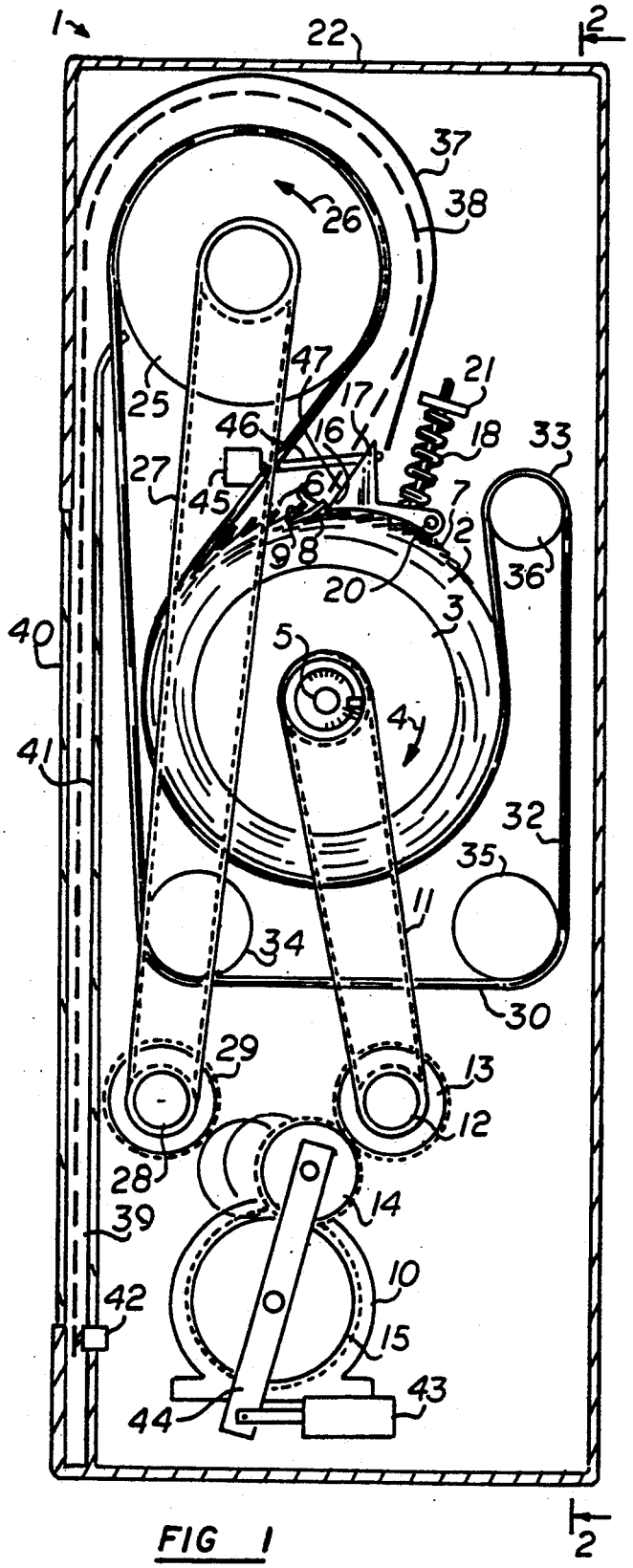
FIG. 1 is a side view of a banner display apparatus according to the invention.
Figure 2:
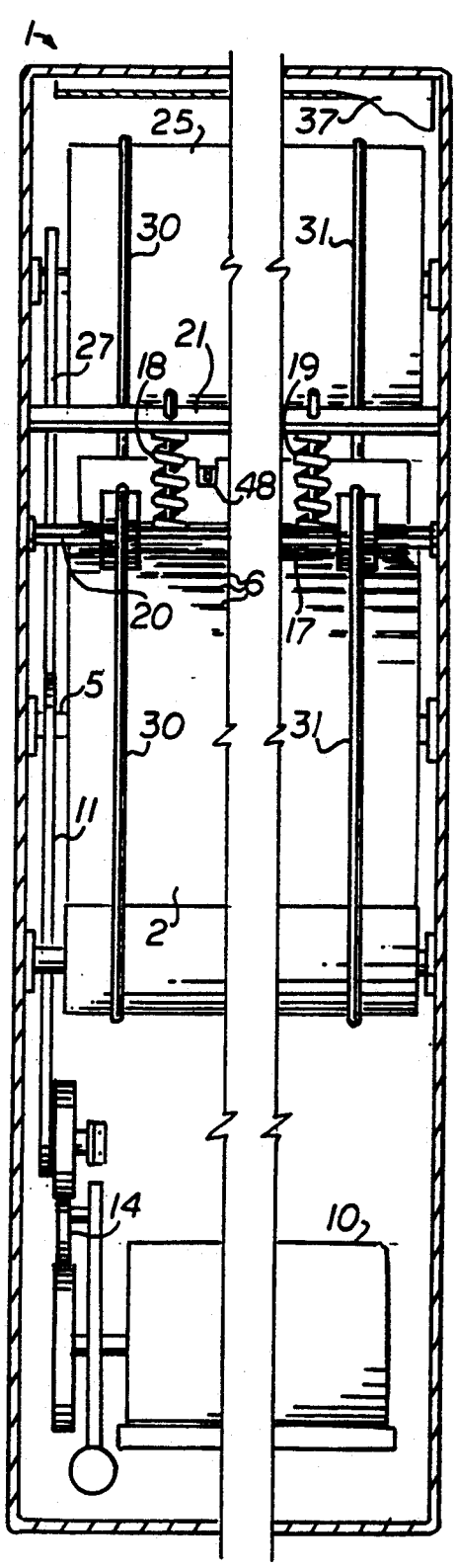
FIG. 2 is a cross-sectional view thereof taken along line 2—2 of FIG. 1.

Referring now to the drawings there is shown in FIGS. 1 and 2 a random banner display apparatus 1 according to the invention. A stack 2 of banners having substantially the same dimensions is wound around a wind-in roller 3 in a first rotational direction indicated by arrow 4. The front of each banner which is to be displayed faces inwardly toward the axle 5 of the wind-in roller. The stack is arranged in such a way that the leading edges 6 of the banners are staggered essentially equally around the peripheral surface 7 of the wound stack 2. In other words, the leading edge 8 of any banner protrudes slightly from under the leading edge 9 of the banner immediately above. The simplest way of doing this is to use similarly sized banners and to attach them at equally spaced intervals around the wind in roller. The wind-in roller 3 and stack 2 are rotated inversely to the banner winding direction 4 by an electric motor 10 via chain 11, sprocket 12 coupled to gear 13, translatable planetary gear 14 and motor gear 15. During this counter-rotation, the acute edge 16 of a blade 17 is pressed against the periphery 7 of the stack of banners by a pair of compression springs 18, 19. The blade 17 is supported by a pivot pin 20, and the springs bear against a cross-bar 21 spanning the housing 22 of the apparatus. Accordingly, the acute edge 16 of the blade bears obliquely in a wiping action against the leading edges of the banners tightly constringing and compacting the stack around the wind-in roller 3 during the wind-in process and any subsequent banner search procedure.

As shown in FIG. 3, when the rotation of the wind-in roller is interrupted, the acute edge 16 of the blade 17 presses against the leading edge 23 of a banner located immediately under the banner 24 which is to be displayed next. If the wind-in roller is caused to rotate in the opposite direction, that is the direction 4 in which the banners are wound around the wind-in roller, the edge of the blade digs under the edge 24 of the nearest banner lifting that edge and peeling that banner and all the banners located above it in the stack off of the wind-in roller, as illustrated in FIG. 4.

A wind-out roller 25 is mounted in a parallel and spaced-apart position above the blade 17. The wind-out roller is driven in a rotational direction opposite the winding direction 4 of the banners as indicated by arrow 26 by the electric motor 10 via chain 27, sprocket 28 coupled to gear 29, and the translated planetary gear 14. Two parallel and spaced-apart belts 30 and 31 have their inner surface 32 bearing against the wind-out roller 25 and the auxiliary rollers or pulleys 34, 35 and 36 which surround the wind-in roller 3. The external surfaces 33 of the belts wrap around and bear against the wound stack 2 of banners. The belts 30, 31 are preferably made of an elastomeric material such as O-ring stock and are tightly stretched to accommodate variation in the circumference of the stack 2 of banners as some or all of them are peeled away during the selective display process. Alternately, one of the auxiliary rollers or pulleys 34, 35, and 36 could be mounted on a tensioned translating shaft in order to keep the belts taut.

As the wind-out roller 25 is thus rotated, the banner peeling process takes place.

A shroud 37 surrounding the wind-out roller 25 guides the set of banners that have been peeled off the wind-in roller 3 around the wind-out roller as indicated by broken line 38 and down into the display frame 39. The display frame has a glass window 40 through which the front of the lowermost of the peeled banners can be seen. The inner face of the backwall 41 of the frame may carry graphics or a message which would appear when no banner is present in the display frame 39 or between the change of banners. A switch 42 located at the bottom of the display frame 39 is closed when the leading edge of the banner being displayed is properly centered in the display frame. This switch closure is used to stop the transport of the banner by shutting off motor 10 or by moving the planetary gear 14 associated with the motor 10 away from the coupling gear 29 by means of solenoid 43. The banner is unloaded by moving the planetary gear 14 into contact with gear 13, and causing the wind-in cylinder 3 to rewind the peeled banners. The solenoid 43 may comprise two coils in order to place the planetary gear lever 44 either in the rewind position where the planetary gear 14 contacts gear 12, in the banner loading position wherein the planetary gear 14 contacts gear 29. A second switch 45 has a lever 46 that extends across the banner path along the front face 47 of the blade and into a notch 48 in the top of the blade. A closure of this switch indicates that all banners have been rewound around the wind-in roller 3.

FIG. 5 illustrates the control mechanism of the banner display apparatus. An indexing wheel 49 associated with the axle 5 of the wind-in roller 3 is scanned by a detector 50 which feeds to a comparator 51 data corresponding to the angular position of the wind-in roller 3. The comparator 51 also receives from a keypad 52, data corresponding to the angular position of the leading edge of the banner to be displayed. The comparator is only activated when the switch 45 is closed, that is when all the banners have been rewound. Upon coincidence between the two sets of data fed to the comparator, a signal is issued to the motor control unit 53 which causes the motor to stop, thus stopping the rotation of the wind-in roller 3. The friction of the system is sufficient to stop the wind-in roller when the acute edge 16 of the blade 17 presses against the leading edge 23 of the banner immediately under the one to be selected as illustrated in FIG. 3. At that point the solenoid 43 can be made to bring the planetary gear 14 into engagement with gear 29, and the motor to start, to begin the banner display by rotating the wind-out roller 25 until closure of the display frame switch 42. As an alternate means to detect the desired positioning of the wound stack of banners under the acute edge 16 of the blade 17, each banner leading edge can be marked with an identifying code 54 which is scanned by a code reader 55. The output of the code reader can be sent to the comparator in lieu of the signal derived from the index wheel reader 50.

FIG. 6 illustrates a first alternate embodiment of the banner wind-out system which uses a single auxiliary roller or pulley 57 in addition to the wind-out cylinder 25. While this embodiment can be made more compact than the first described one, the limited contact of the belts 30, 31 with the periphery of the wound stack of banners may result in a lesser traction of the belts around the circumference of the stack 2 of banners and may ultimately cause slippage of the belts on the banners and resulting failure of the banners to deploy during the wind-out operation. In addition, this limited contact during the wind-in operation, may also produce a lesser compacting of the stack of banners on the wind-in roller 3.

FIG. 7 illustrates a second alternate embodiment 38 of the apparatus in which the banners to be displayed are fed upwardly into a vertical display frame 59.

FIGS. 8 and 9 illustrate a third alternate embodiment 60 of the invention which is integrated into a bench 61. The bench is of the type ordinarily seen at bus stops, and comprises a sitting surface 62 and a backrest 63. The display frame 64 is incorporated in the backrest so that the banners can be seen through a window 65 located where advertising is commonly painted on such benches. The display window 64 can be backlit with fluorescent lights 66, the banner storage and display mechanism is housed in an enclosure 67 securely and conveniently located under the seating surface 62.

It should be noted that in each embodiment, the wind-in roller 3 should be easily detachable from its operating position so that the stack of banners can be quickly replaced or updated. It should also be noted that since the front of the banners are facing inwardly on the wound stack, the message or graphics are protected against wear and discoloration that could be caused by the blade 17 and the belts 30, 31.

Figure 10:
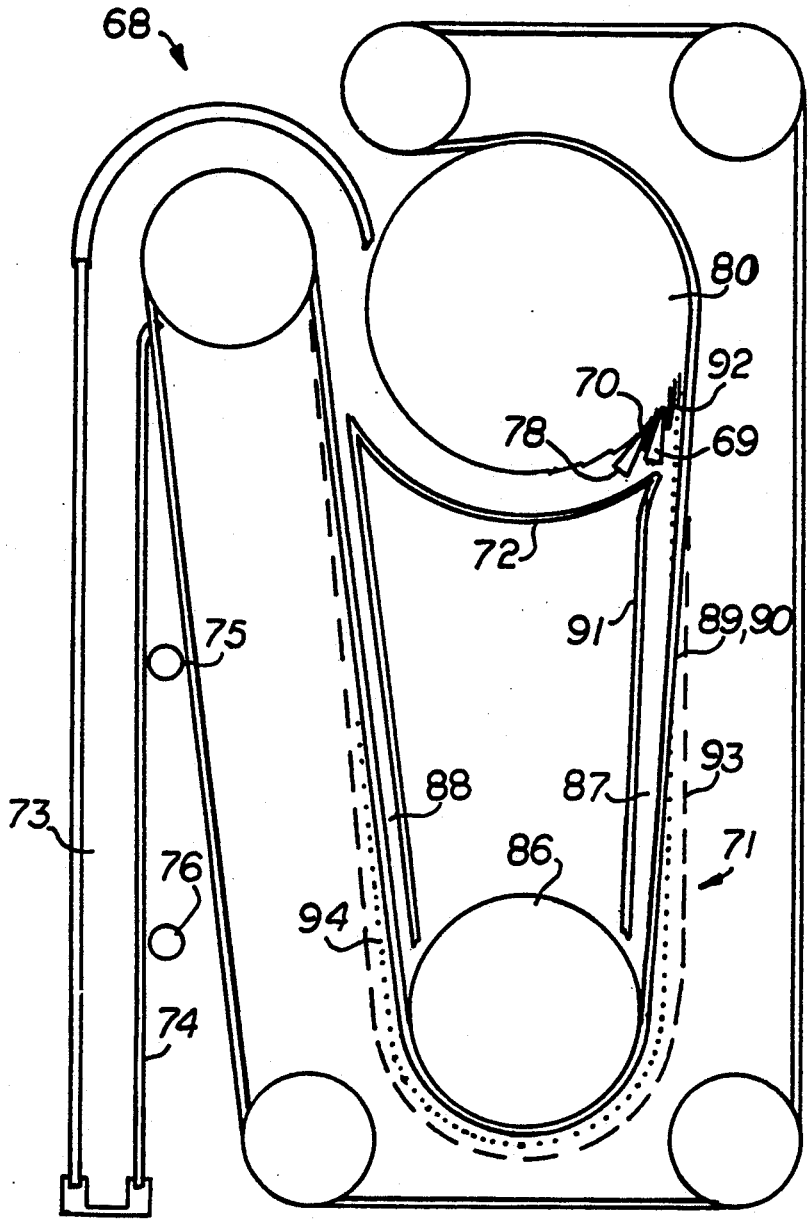
FIG. 10 is a side view of an alternate embodiment of the invention using a second knife to isolate the displayed banner.
Figure 11:
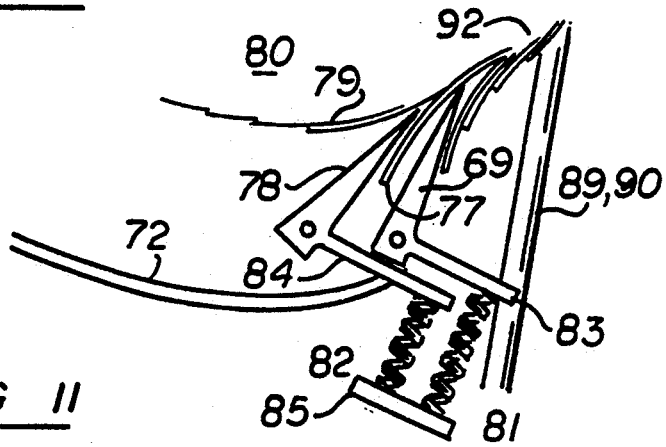
FIG. 11 is a detailed view of the dual knife banner peeling mechanism.

FIGS. 10 and 11 illustrate a fourth alternate embodiment 68 of the invention characterized by the use of a second knife 69 to separate the selected banner 70 from those, if any, located immediately above it. The latter are directed toward a temporary storage station 71 while the selected banner 70 is guided by a circular part 72 of the baffle 91 toward the display case 73. The back wall 74 of the display case is translucent and lights 75, 76 mounted behind the translucent wall are used to backlight the banner which can conveniently be made of a transparent or translucent material. As shown in FIG. 11, the second knife 69 bears against the leading edge 77 of the selected banner 70, while the first knife 78 bears against the adjacent leading edge 79 of the banner immediately under it when they are wound around the wind-in roller 80. The spacing between the bearing edges of the two knives 69, 78 corresponds to the spacing between the adjacent leading edges of two wound banners.

The knives 69, 78 are resiliently pushed against the leading edges of the banners wound around the wind-in roller 80 by a set of compressing springs 81, 82 placed between the respective levers 83, 84 of the blades and a stationary support bar 85.

The temporary storage station 71 includes a guiding drum 86 and the two areas 87, 88 on either side of it between the belts 89, 90 and the baffles 91. As the selected banner 70 is unrolled and guided into the display case 73, the stack of banners 92 that was wound on the wind-in roller 80 on top of the selected one is led by the belts around the guiding drum 86. The belts expand as shown by broken line 93 to accommodate the stack of stored banners shown by dotted lines 94. Alternately, the stack 92 could be directed by appropriate guiding baffles to wind around the guiding drum 86. It should be noted that in each of the above-described embodiments of the invention, each banner is attached to a leader which is first wound around the wind-in roller. Each leader must be at least as long as the path distance between the inlet of the display case and the wind-in roller.

While the preferred embodiments of the invention have been described, modifications can be made and other embodiments may be devised without departing from the spirit of the invention and the scope of the appended claims.

What is claimed is:

1. An apparatus for randomly and successively selecting and displaying one of a plurality of stacked banners, which comprises:

a wind-in roller;

a stack of substantially symmetrical banners wound around the wind-in roller in a first rotational direction, wherein a displayable front of each of said banners faces inwardly and leading edges of said banners are staggered in an overlapping arrangement around said stack whereby each of said leading edges extends a short distance beyond the leading edge of the banner immediately above it;

means for compacting said stack of banners around the wind-in roller;

means for seletively peeling any one of said banners off said wind-in roller;

a display frame shaped and dimensioned to receive any one of said banners; and means for winding-out said banner into said display frame;

wherein said means for compacting comprise:

means for rotating said wind-in roller inversely to said first rotational direction;

a first wiping blade having a first acute edge parallel to said leading edges, said acute edge obliquely contacting said periphery of the wound stack; and means for resiliently pressing said blade against said wound stack;

whereby said acute edge compresses said leading edges and constringes said stack around said wind-in roller during rotation inversely to said first rotational direction.

2. The apparatus of claim 1, wherein said means for winding-out comprise a wind-out roller parallel to, and spaced-apart from the wind-in roller;

at least one auxiliary roller parallel to, and spaced-apart from said wind-in roller on an opposite side of said wind-in roller;

at least one resilient, continuous belt having an internal bearing surface wrapped around and bearing against said auxiliary roller and wind-out roller and an outer surface bearing against said wound stack; and wherein said means for selectively peeling comprise:

means for rotating one of said auxiliary and wind-out rollers to drive the wind-in roller by means of said belt in said first rotational direction;

whereby the acute edge of said blade lifts up a nearest leading edge of a banner coming into contact with said acute edge, and peels said banner off the wound stack;

means for directing said nearest leading edge toward said display frame; and means for positioning the leading edge of one of said banners near the acute edge of said blade.

3. The apparatus of claim 2, wherein said means for positioning comprise:

means for indexing rotational positions of said stack;

means for selecting one of said banners; and means, responsive to said means for indexing, for stopping the rotation of the wind-in roller when the leading edge of said selected banner is near the acute edge of said blade.

4. The apparatus of claim 3, wherein said means for winding-out comprise:

at least two of said belts parallelly spaced-apart, each of said belts having a circular cross-section and being made of an elastomeric material.

5. The apparatus of claim 4, wherein said belts are made from O-ring stock.

6. The apparatus of claim 3, wherein said means for indexing comprise an angular position detector axially connected to the wind-in roller.

7. The apparatus of claim 3, wherein said means for indexing comprise each of said leading edges having an identification mark; and means for scanning said mark on the periphery of said wound stack.

8. The apparatus of claim 3 which further comprises:

a bench having a sitting surface and a back rest, said display frame being mounted into said back rest; and an enclosure under said sitting surface housing said wind-in roller, wound stack and means for selectively peeling said banners.

9. The apparatus of claim 3 which further comprises a second wiping blade having a second acute edge parallely spaced apart from said first acute edge;

means for resiliently and obliquely pressing said second acute edge against the periphery of the wound stack at a distance from said first acute edge substantially equal to the distance between two adjacent ones of said leading edges in a direction opposite said first rotational direction;

whereby said second acute edge bears against the leading edge of the selected banner after stopping the rotation of the wind-in roller; and means for guiding any banner wrapped above said selected banner away from said display frame during said rotating of one of said auxiliary and wind-out rollers.

10. The apparatus of claim 9, wherein said means for guiding comprise said auxiliary roller; and a baffle extending between said wind-in roller and said auxiliary roller and parallely spaced-apart from a section of the internal bearing surface of said belt.

11. The apparatus of claim 2, wherein said wind-in roller comprises an axle-driving mechanism; and said apparatus further comprises:

a belt-driving assembly and means for alternately and exclusively driving said wind-in roller peripherally by means of said belt, or axially by means of said axle-driving mechanism.

12. The apparatus of claim 11, wherein said means for alternately and exclusively driving comprises:

an unidirectional motor; and a means for coupling said motor either to said axle-driving mechanism or to said belt-driving assembly.

13. The apparatus of claim 12, wherein said means for coupling comprise a planetary gear clutch device.

* * * * *